US008523598B2

(12) United States Patent
Wu

(10) Patent No.: US 8,523,598 B2
(45) Date of Patent: Sep. 3, 2013

(54) ELECTRICAL CONNECTOR ASSEMBLY WITH A LATCH EASY TO BE OPERATED

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 239 days.

(21) Appl. No.: 13/074,018

(22) Filed: Mar. 29, 2011

(65) Prior Publication Data

US 2011/0237112 A1 Sep. 29, 2011

(51) Int. Cl.
*H01R 13/627* (2006.01)

(52) U.S. Cl.
USPC ..... 439/358; 439/352

(58) Field of Classification Search
USPC ..... 439/350–358, 76.1, 595
See application file for complete search history.

(56) References Cited

U.S. PATENT DOCUMENTS

| | | | | | |
|---|---|---|---|---|---|
| 4,443,048 | A | * | 4/1984 | Moist, Jr. | 439/599 |
| 4,544,220 | A | * | 10/1985 | Aiello et al. | 439/595 |
| 4,884,978 | A | * | 12/1989 | Inaba et al. | 439/352 |
| 5,342,221 | A | * | 8/1994 | Peterson | 439/677 |
| 5,643,009 | A | * | 7/1997 | Dinkel et al. | 439/595 |
| 7,303,438 | B2 | | 12/2007 | Dawiedczyk et al. | |
| 7,581,978 | B1 | | 9/2009 | Briant | |

* cited by examiner

*Primary Examiner* — Briggitte R Hammond
(74) *Attorney, Agent, or Firm* — Wei Te Chung; Ming Chieh Chang

(57) ABSTRACT

An electrical connector assembly (100), comprising: an insulative housing (1) having at least one receiving space formed therein; a latch (3) formed on a top surface of the insulative housing, the latch defining a front end connected to the top surface and a rear end cantilevered from the front end; and two PCB modules (2) received into each receiving space (11), one of the two PCB modules defining a holding portion (231) holding the rear end of the latch.

19 Claims, 9 Drawing Sheets

ELECTRICAL CONNECTOR ASSEMBLY WITH A LATCH EASY TO BE OPERATED

FIELD OF THE INVENTION

The present invention generally relates to connectors suitable for transmitting data, more specifically to input/output (I/O) connectors with high-density configuration and high data transmitting rate.

DESCRIPTION OF PRIOR ART

Mini SAS connectors are widely used in the server. And, a physical channel rate of the Mini SAS connector is reach to 3 Gbps. However, the above said data transmitting rate will not meet more and more higher data transmitting rate requirements of the server. And, nowadays, the physical channel rate of the Mini SAS connector is reach to 6 Gbps or more faster.

Additionally, the electrical connector will has a developing trend to form multi-ports on a front end thereof to meet the above said requirements. As a result, a width of the electrical connector becomes larger. Thus, a latch formed on the electrical connector will be difficult to operate to achieve an engagement and disengagement between the electrical connector and the complementary connector.

As discussed above, an improved electrical connector overcoming the shortages of existing technology is needed.

SUMMARY OF THE INVENTION

Accordingly, an object of the present invention is to provide an electrical connector assembly with an easily operating latching mechanism and high data transmitting rate.

In order to achieve the above-mentioned objects, an electrical connector assembly, comprises an insulative housing having at least one receiving space formed therein; a latch formed on a top surface of the insulative housing, the latch defining a front end connected to the top surface and a rear end cantilevered from the front end; and two PCB modules received into each receiving space, one of the two PCB modules defining a holding portion holding the rear end of the latch.

Other objects, features and advantages of the invention will be apparent from the following detailed description taken in connection with the accompanying drawings.

DETAILED DESCRIPTION OF PREFERRED EMBODIMENTS

Figure 1:
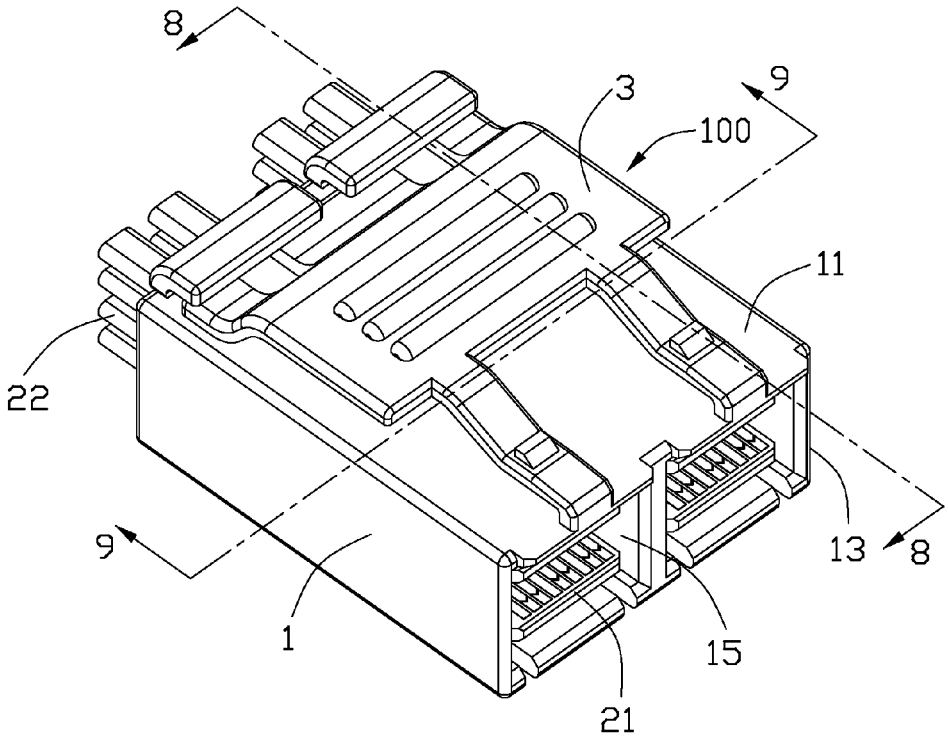
FIG. 1 is a perspective view of an electrical connector assembly in accordance with the present invention.

Reference will now be made to the drawing figures to describe the present invention in detail.

Figure 2:
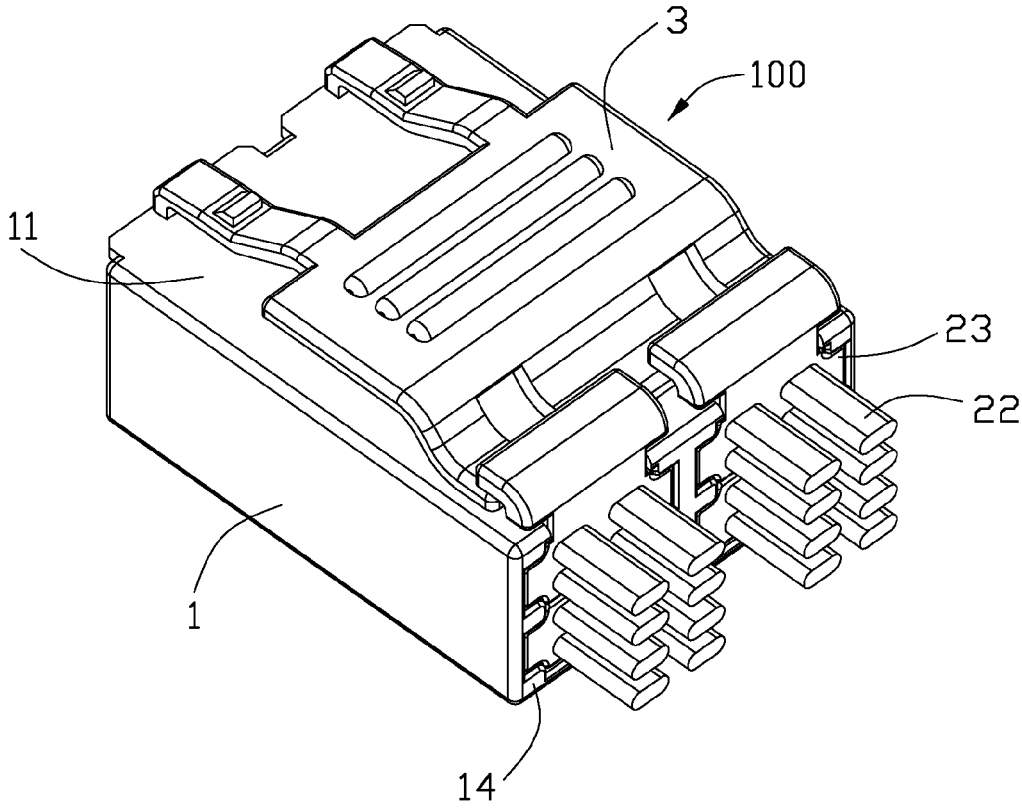
FIG. 2 is similar to FIG. 1, but viewed from another aspect.
Figure 3:
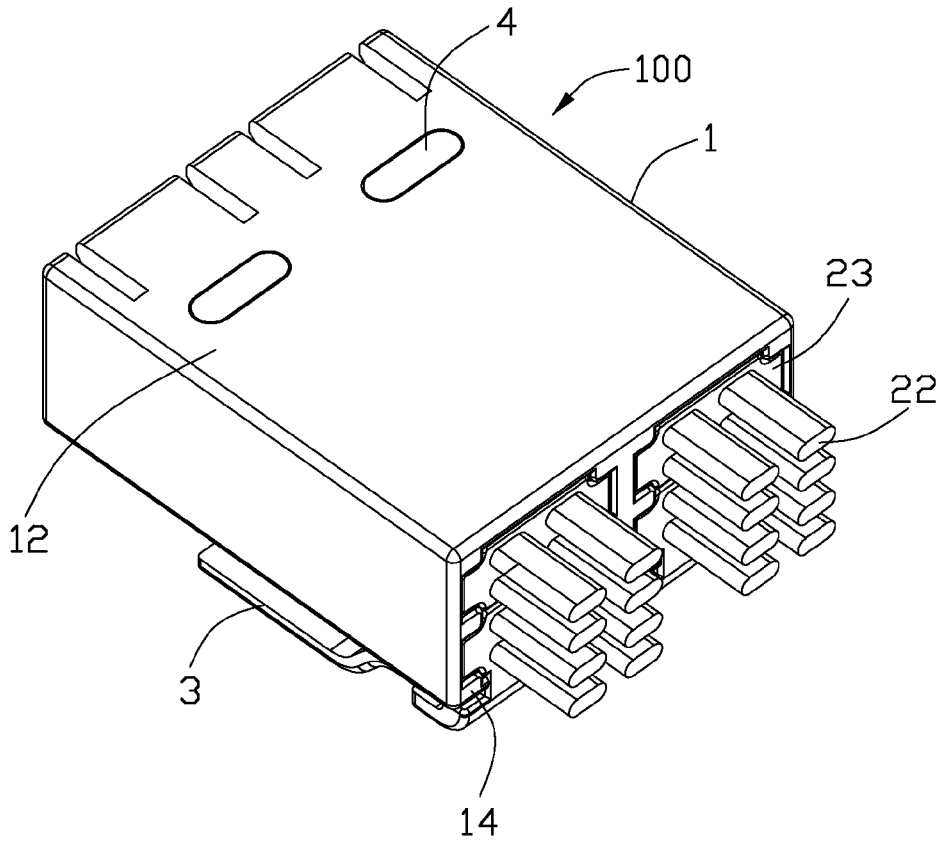
FIG. 3 is similar to FIG. 2, but viewed from another aspect.
Figure 4:
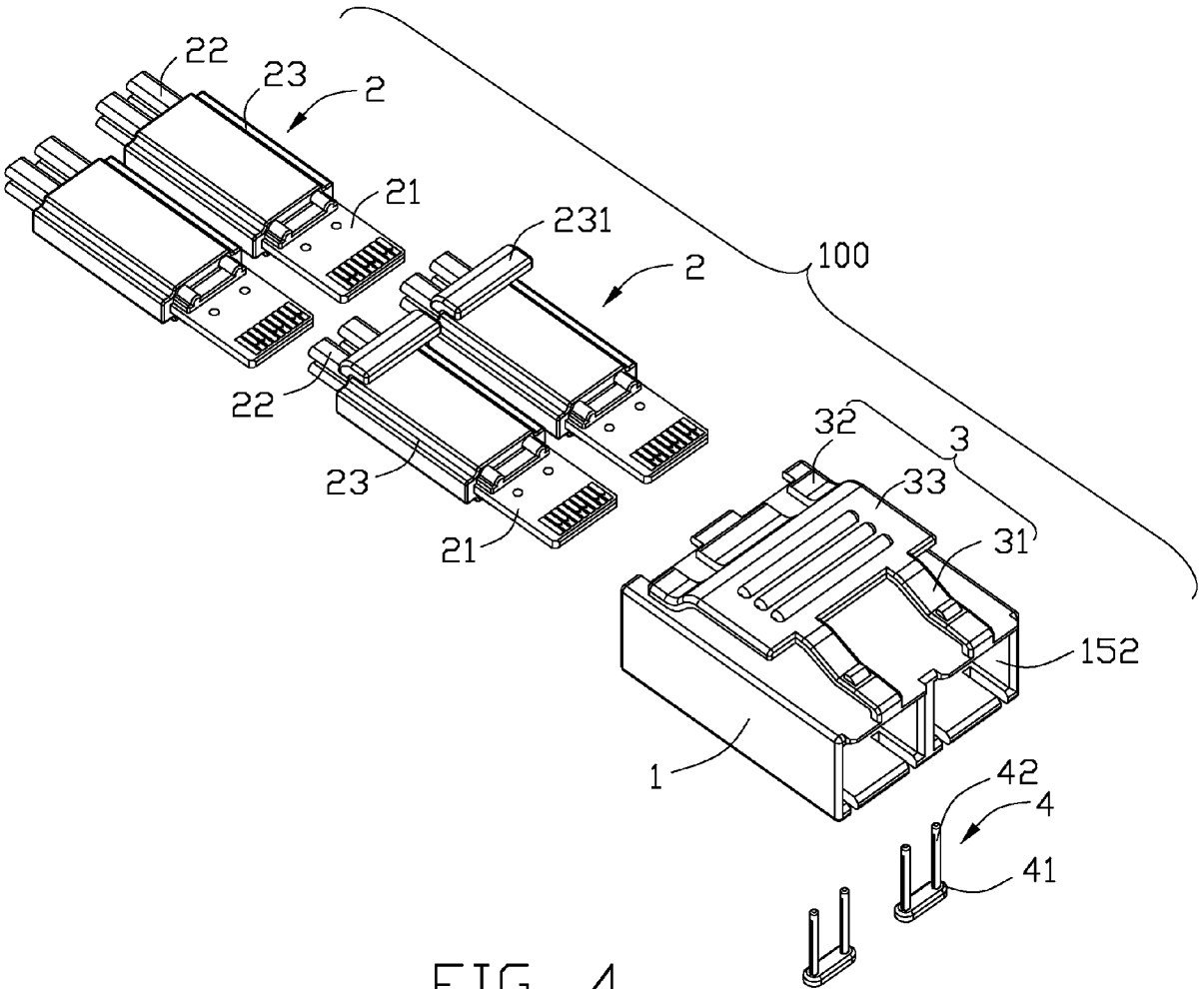
FIG. 4 is an exploded, perspective view of the electrical connector assembly of FIG. 1.
Figure 5:
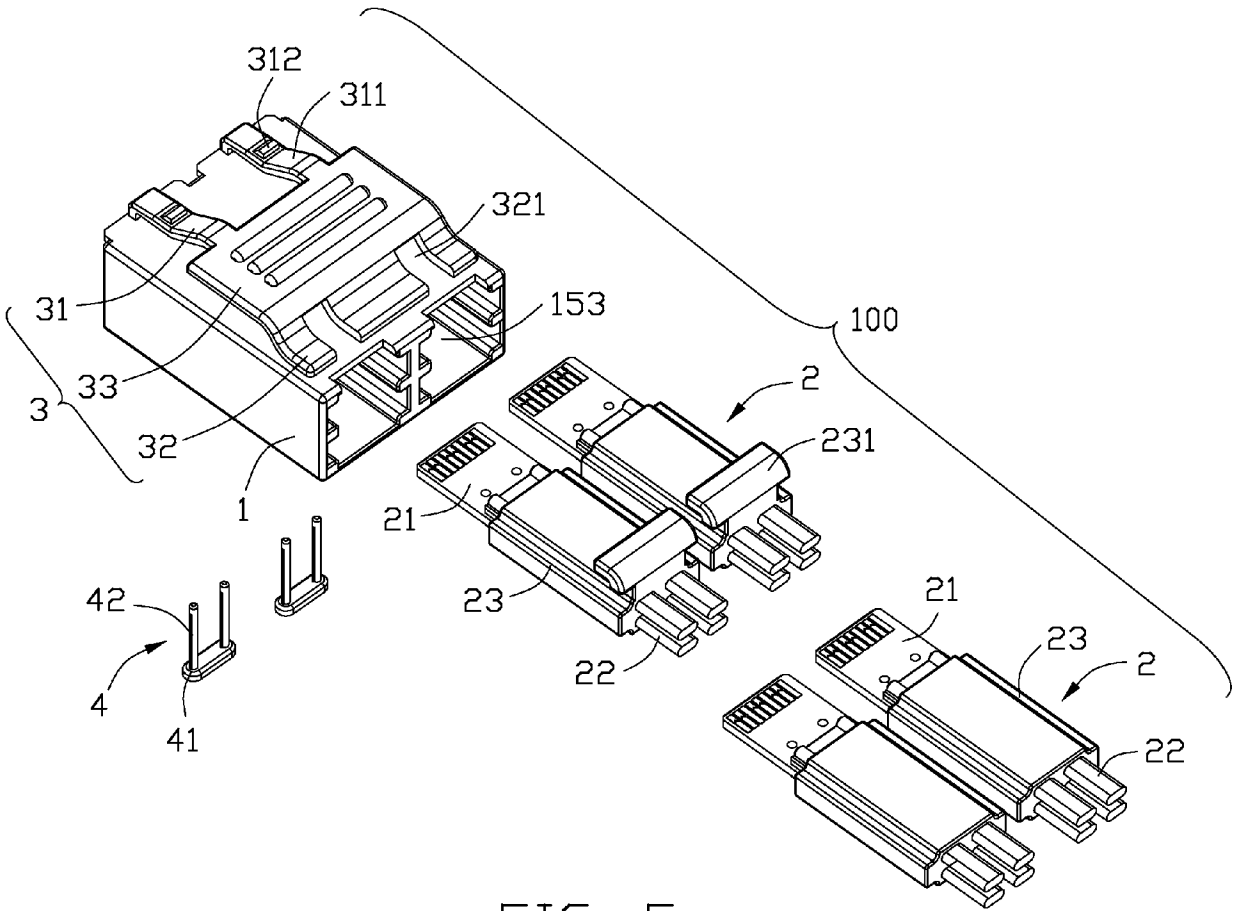
FIG. 5 is an exploded, perspective view of the electrical connector assembly of FIG. 2.
Figure 6:
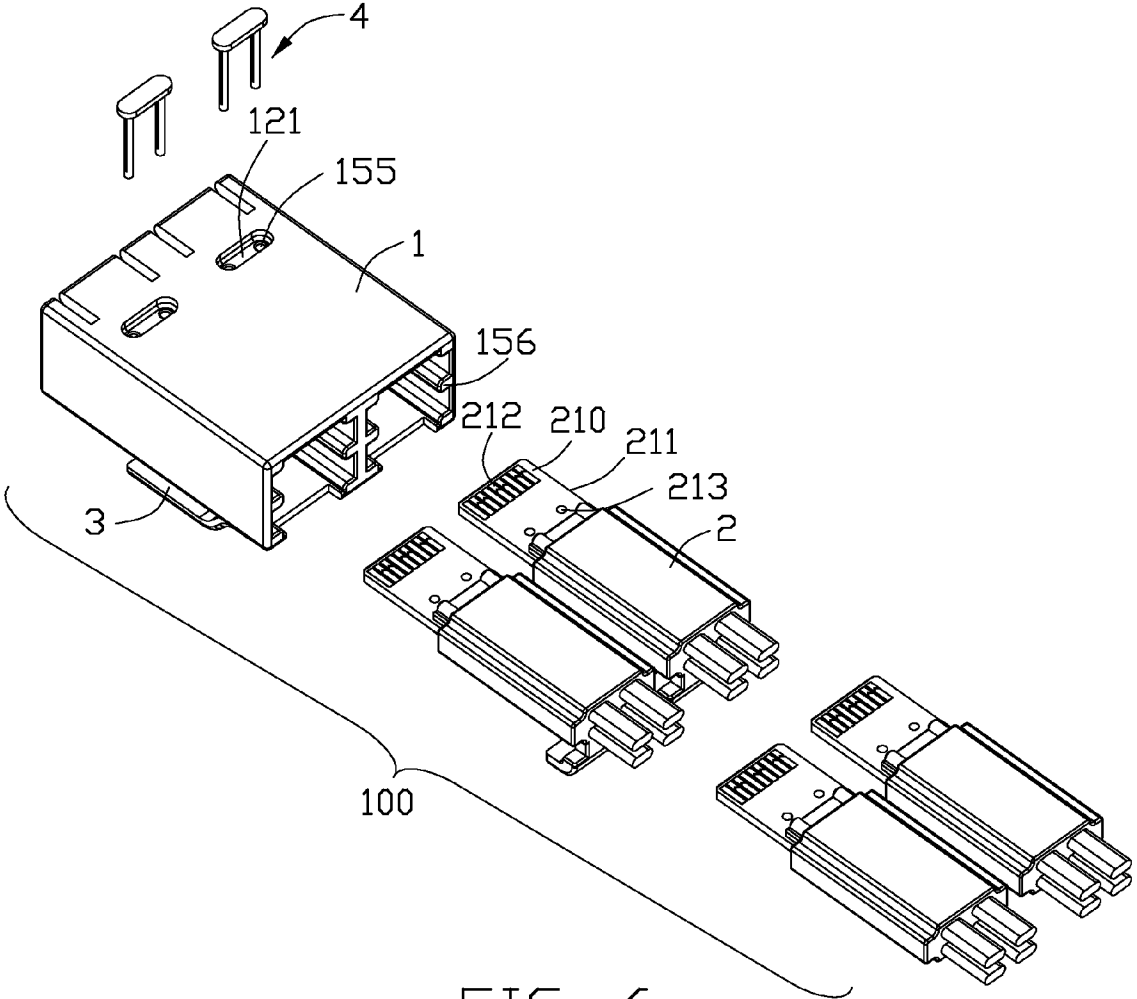
FIG. 6 is an exploded, perspective view of the electrical connector assembly of FIG. 3.
Figure 7:
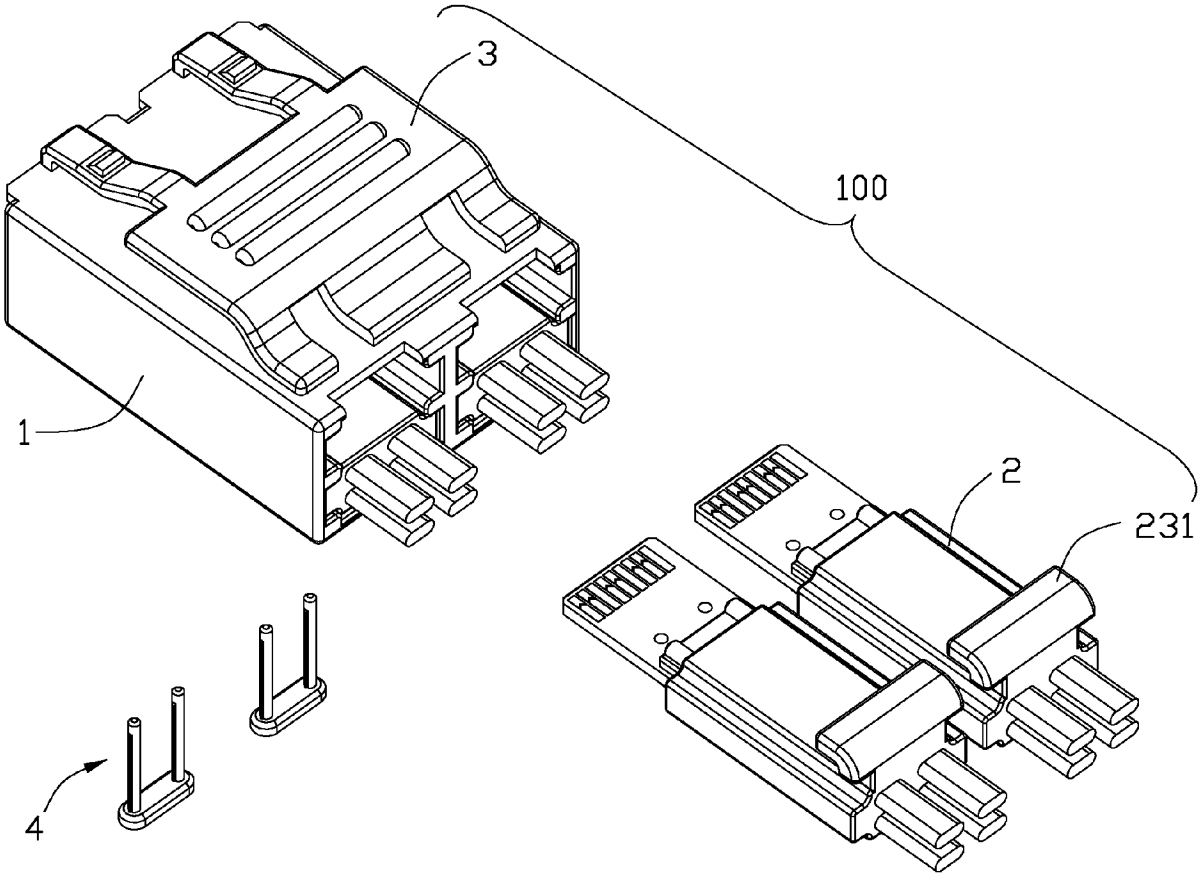
FIG. 7 is a partially assembled view of the electrical connector assembly of FIG. 2.

FIGS. 1 to 3 illustrate perspective views of an electrical connector assembly 100 made in accordance with the present invention. Referring to FIGS. 4 to 7, the electrical connector assembly 100 comprises a box-shape insulative housing 1, four PCB modules 2 disposed in the insulative housing 1, a resilient latch 3 formed on a top surface 11 of the insulative housing 1. The electrical connector assembly 100 further comprises two retainers 4 assembled to the insulative housing 1 and interfered with the four PCB modules 2 to make the insulative housing 1 and the four PCB modules 2 positioned together.

Figure 8:
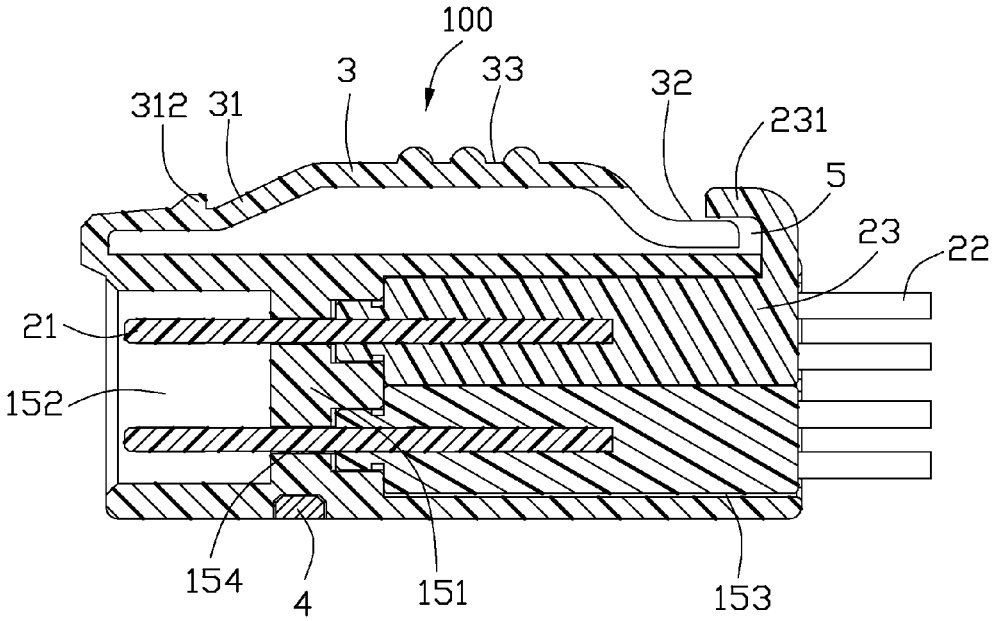
FIG. 8 is a cross section view of the electrical connector assembly of FIG. 1 taken along line 8-8.

Referring to FIGS. 1 to 6 and in conjunction with FIG. 8, the insulative housing 1 defines a top surface 11 and a bottom surface 12 opposite with each other, a front surface 13 and a rear surface 14 opposite with each other. The insulative housing 1 defines two receiving spaces 15 arranged along a transversal direction and spaced apart with other. Each receiving space 15 extends from the front surface 13 to the rear surface 14 along a longitudinal direction. The insulative housing 1 defines two partitions 151 respectively formed in the two receiving spaces 15. Thus, each receiving space 15 is divided into a front receiving room 152 and a rear receiving room 153 by the partition 151. And each front receiving room 152 can also be defined as a mating port of the electrical connector assembly 100. A pair of ribs 156 are respectively formed on two inner side surfaces of each rear receiving room 153 to separate two PCB modules 2. Each partition 15 defines two slots 154 throughout the partition 15 along a front to rear direction. Two slots 154 are arranged along a vertical direction and paralleled with each other. The front receiving room 152 communicates with the rear receiving room 153 by two slots 154. In addition, the insulative housing 1 defines two recesses 121 formed on a bottom surface thereof and arranged along a transversal direction. Each recess 121 is in alignment with a partition 151 along a vertical direction. The partition 15 defines a pair of vertical receiving holes 155 arranged along a transversal direction and extending downwardly and communicated with the recess 121. Each receiving hole 152 is crossed with two paralleled slots 154.

Referring to FIGS. 4 to 7, each PCB module 2 comprises a printed circuit board 21, a plurality of cables 22 electrically connected with the printed circuit board 21 and an insulator 23 integrative formed around a front end of the cables 22, a rear end of the printed circuit board 21 and a connection between the printed circuit board 21 and the insulator 23. The printed circuit board 21 defines a mating section 210, a connecting section 211 disposed in back of the mating section 210 and a soldering section (not shown) disposed in back of the connecting section 211 and electrically connected with the cables 22. The mating section 210 defines a plurality of conductive pads 212 formed on two opposite upper and lower surfaces thereof and arranged along a transversal direction. The connecting section 211 defines two positioning holes 213 spaced apart with each other and arranged along a transversal direction. When the PCB modules 2 are assembled to the insulative housing 1, the mating section 210 of the printed circuit board 21 of each PCB module 2 is passed through the slot 154 and received into front receiving room 152 of the housing 1. And, the insulator 23 is received into the rear receiving room 153 of the housing 1. It should be noted that two PCB modules 2 of four PCB modules 2 have a different structure with another two PCB modules 2 of four PCB modules 2. Two PCB modules 2 of four PCB modules 2 have two holding portions 23 respectively formed on the two insulators 23 of the two PCB modules 2. Each holding portion 231 is formed on a rear end of a top surface of the insulator 23. Each holding portion 231 extends upwardly and forwardly from the top surface of the insulator 23. The holding portion 231 defines a vertical section and a horizontal section extending forwardly from a top end of the vertical section. However, another two PCB modules 2 of four PCB modules 2 do not have two above said holding portions 231 formed on the two insulators 23. So, the PCB module 2 with holding portion 231 is defined as a first PCB module 2. The PCB module 2 without holding portion 231 is defines as a second PCB module 2. In another embodiment, the two printed circuit boards 21 can be formed together by one insulator. Thus, one PCB module is formed by two printed circuit boards 21 and one insulator integrative formed around two rear ends of the two printed circuit boards 21. Thus, one PCB module can be received into a receiving space 15. And the holding portion is also formed on the insulator of the PCB module.

Referring to FIGS. 1 to 7 and in conjunction with FIG. 8, the latch 3 has two front ends connected to a front edge of the top surface 11 of the insulative housing 1 and a body portion extending upwardly and rearwardly from the front ends of the latch 3 and located above the top surface 11 of the insulative housing 1. And the two front ends of the latch 3 are unitary formed on the top surface 11 of the insulative housing 1. The latch 3 has a rear end cantilevered from the two front ends of the latch 3. The latch 3 defines a latching portion 31 formed at a front section thereof, a rear portion 32 and a pressing portion 33 disposed between the latching portion 31 and the rear portion 32. The latching portion 31 comprises a pair of arms 311 connected to the top surface 11 of the insulative housing 1. Each arm 311 defines a wedge-shaped projection 312 formed on a top surface thereof for latching with a complementary connector. The pressing portion 33 is flat and has a plurality of ribs formed on a top surface thereof for easily operating. The rear portion 32 extends downwardly and rearwardly from a rear edge of the pressing portion 33 and defines two cutouts 321 spaced apart with each other.

Figure 9:
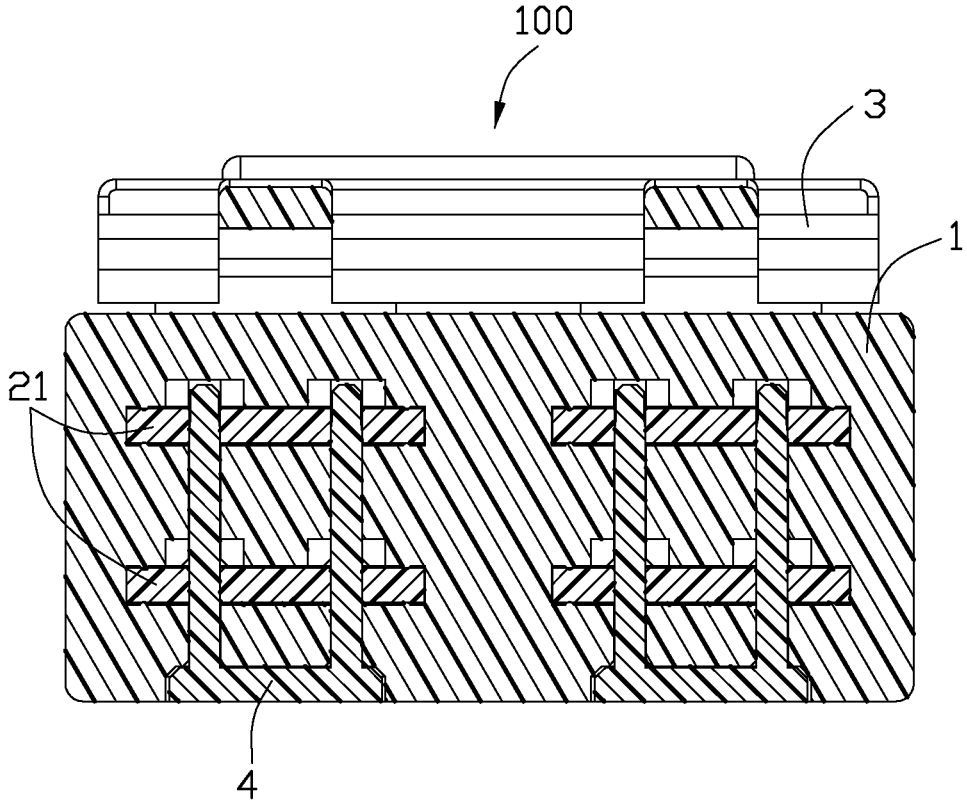
FIG. 9 is a cross section view of the electrical connector assembly of FIG. 1 taken along line 9-9.

Referring to FIGS. 3 to 7 and in conjunction with FIG. 9, each retainer 4 is made of insulative material and has a base portion 41 and a pair of positioning posts 42 extending from a top surface of the base portion 41 for a distance.

Referring to FIGS. 1 to 9, the assembling process of the electrical connector assembly 100 made in according to the present invention starts from assembling two second PCB modules 2 respectively into a lower side of each receiving space 15. The mating section 210 of each second PCB module 2 is passed through the partition 151 and received into the front receiving room 152 through the slot 154. Two positioning holes 213 of the second PCB modules 2 are in alignment with the receiving holes 155 of the insulative housing 1 along an up-to-down direction.

After the two second PCB modules 2 are respectively received into the two receiving spaces 15 of the insulative housing 1, then assembling the two first PCB modules 2 to the insulative housing 1. Each first PCB module 2 is received into an upper side of the receiving space 15 and disposed upon the second PCB module 2. The mating section 210 of each first PCB module 2 is also passed through the partition 151 and received into the front receiving room 152 through the slot 154. Two positioning holes 213 of the first PCB modules 2 are also in alignment with the receiving holes 155 of the insulative housing 1 along an up-to-down direction. It should be noted that a rear end of the rear portion 32 of the latch 3 is disposed below the two holding portions 23 of the two first PCB modules 2 and limited to raise up by the two holding portions 23 of the two first PCB modules 2. Thus, the latch 3 will not be resumed to an original state before the two first PCB modules 2 assembled to the insulative housing 1. When the two first PCB modules 2 are all received into the insulative housing 1, a receiving slot 5 is formed between the holding portion 2311 and the top surface 11 of the insulative housing 1. The rear end of the rear portion 32 of the latch 3 is also seemed to be received into the receiving slot 5. After the two first PCB modules 2 are respectively received into the corresponding receiving space 15. Two mating sections 210 of the two stacked PCB modules 2 are both disposed in the front receiving room 152 of each receiving space 15. And, two insulators 23 of the two stacked PCB modules 2 are both received into the rear receiving room 153 of each receiving space 15. The cables 22 of each PCB module 2 extend rearwardly and out of the insulative housing 1.

At last, assembling the two retainers 4 to the bottom surface 12 of insulative housing 1. The pair of positioning posts 42 of each retainer 4 are received into the receiving holes 155 of the partition 15 and passed through the two positioning holes 213 of the printed circuit board 21. Thus, each retainer 4 is interfered with two PCB modules 2 to make the two PCB modules 2 positioned to the insulative housing 2. The base portion 41 of the retainer 4 is received into the recess 121.

After the above assembling steps, the entire process of assembling of the electrical connector assembly 100 is finished. Obviously, the resilient latch 3 formed on the insulative housing 1 is simple and easy to operate to achieve an engagement and disengagement between the electrical connector assembly 100 and the complementary connector (not shown). When the pressing portion 33 is deserved by a downward force, a downward movement of the latch 3 will be achieved. The latching portion 31 of the latch 3 will also move downwardly. Thus, the electrically connector assembly 100 can be mated with a complementary connector (not shown). When the downward force is released, the electrically connector assembly 100 will latch to the complementary connector (not shown).

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

an insulative housing having at least one receiving space formed therein;

a latch formed on a top surface of the insulative housing, the latch defining a front end connected to the top surface and a rear end cantilevered from the front end; and two PCB modules received into each receiving space, one of the two PCB modules defining a holding portion holding the rear end of the latch.

2. The electrical connector assembly as recited in claim 1, wherein at least one receiving space comprise two receiving spaces spaced apart with each other and arranged along a transversal direction.

3. The electrical connector assembly as recited in claim 1, wherein the two PCB modules are stacked with other, and two PCB modules comprises a first PCB module located on an upper side of the receiving space and a second PCB module located on a lower side of the receiving space, the holding portion formed on the first PCB module.

4. The electrical connector assembly as recited in claim 1, wherein the latch defines a latching portion formed on a front section thereof, a rear portion and a pressing portion connected with the latching portion and the rear portion.

5. The electrical connector assembly as recited in claim 4, wherein the latching portion of the latch comprises two arms unitary extending from the top surface of the insulative housing, each arm defines a projection for latching with a complementary connector.

6. The electrical connector assembly as recited in claim 1, wherein the insulative housing defines a partition formed in each receiving space to divide the receiving space into a front receiving room and a rear receiving room, two front sections of the two PCB modules are passed through the partition and disposed in the front receiving room.

7. The electrical connector assembly as claimed in claim 6, wherein the two PCB modules have corresponding rear sections directly touching each other and disposed in the rear receiving room.

8. The electrical connector assembly as recited in claim 1, wherein each PCB module comprises a printed circuit board, a plurality of cables electrically connected to a rear end of the printed circuit board and an insulator formed on a front end of the cables, a rear end of the printed circuit board and a connection between the printed circuit board and the cables, and the holding portion unitary formed on the insulator of the PCB module.

9. The electrical connector assembly as recited in claim 8, further including a retainer secured to the housing and extending in the partition and through both said two printed circuit boards.

10. An electrical connector assembly, comprising:

a housing defining at least one receiving space formed therein;

two paralleled printed circuit boards disposed in each receiving space;

a latch unitarily formed on a top surface of the housing, the latch defining a front end connected to the housing and a rear end cantilevered from the front end; and an insulator enclosing two rear ends of the two printed circuit boards and disposed in a rear end of the receiving space of the housing, and the insulator defining a holding portion attaching to the rear end of the latch for preventing an upward movement of the rear end of the latch.

11. The electrical connector assembly as recited in claim 10, further comprising a plurality of cables respectively electrically connected with two rear ends of the two printed circuit boards, the insulator is formed by two sections respectively formed on a connection between a printed circuit board and a plurality of cables.

12. The electrical connector assembly as recited in claim 10, wherein the latch defines a latching portion formed on a front section thereof, a rear portion and a pressing portion connected with the latching portion and the rear portion.

13. The electrical connector assembly as recited in claim 10, wherein the housing defines a partition formed in the receiving space to divide the receiving space into a front receiving room and a rear receiving room.

14. The electrical connector assembly as recited in claim 13, wherein the electrical connector assembly further comprises at least one retainer extending in the partition and through both said two printed circuit boards.

15. The electrical connector assembly as recited in claim 13, wherein two front mating sections of the two printed circuit boards are disposed into the front receiving room, the insulator is disposed into the rear receiving room.

16. An electrical cable connector assembly comprising:

a housing defining a mating port therein;

a contact module located in the housing with contacting sections exposed in the mating port; and a latch structure located on one exterior face of the housing, said latch structure being of a cantilevered manner and defining thereof a root section on a front portion and a free end on a rear portion; wherein the contact module defines a hook structure exposed above said exterior face to engage the free end of the latch structure for preventing excessive outward deflection of the latch structure;

wherein said contact module includes a printed circuit board located in a front portion of the housing and held by a holding portion located in a rear portion of the housing under condition that the hook structure is formed on the holding portion.

17. The electrical cable connector as claimed in claim 16, wherein a plurality of cables connected to a rear region of the printed circuit board and extend through the holding portion.

18. The electrical cable connector as claimed in claim 17, wherein said latch structure is unitarily formed with the housing.

19. The electrical cable connector as claimed in claim 18, wherein said contact module is forwardly assembled to the housing to have the hook structure confront the free end of the latch structure in both horizontal and vertical directions.

* * * * *